United States Patent [19]

Whiteman, Jr.

[11] Patent Number: 4,895,277

[45] Date of Patent: Jan. 23, 1990

[54] FOOT OPERATED MORTAR DRUM LATCH ASSEMBLY

[76] Inventor: Marvin E. Whiteman, Jr., 2254 Braniff St., Boise, Id. 83706

[21] Appl. No.: 306,081

[22] Filed: Feb. 3, 1989

[51] Int. Cl.[4] ..... B28C 7/16; B67D 5/64; B01F 15/02

[52] U.S. Cl. ..... 222/166; 222/179; 366/47; 366/185

[58] Field of Search ..... 222/153, 164, 166, 179; 366/45–47, 185; 414/421; 298/17 R, 38

[56] References Cited

U.S. PATENT DOCUMENTS

| | | | |
|---|---|---|---|
| 924,047 | 6/1909 | Ellmann | 222/179 |
| 2,099,253 | 11/1937 | Bagby | 222/179 |
| 3,905,519 | 9/1975 | Tertinek | 222/166 |
| 4,547,143 | 10/1985 | Cerreta | 222/166 X |
| 4,699,517 | 10/1987 | Sella | 366/45 |

FOREIGN PATENT DOCUMENTS

| | | | |
|---|---|---|---|
| 3872 | 4/1901 | Denmark | 222/179 |
| 26948 | 8/1902 | Switzerland | 222/164 |
| 117557 | 7/1918 | United Kingdom | 222/179 |

*Primary Examiner*—Kevin P. Shaver
*Attorney, Agent, or Firm*—Frank J. Dykas; Craig M. Korfanta

[57] ABSTRACT

A foot operated mortar drum latch assembly having V-stop tab 15 extending normally from drum end wall 25. A latch bar 14 is provided, and is pivotally attached to upright frame strut 24 adjacent to drum end wall 25 for frictional engagement with V-stop tab 15. Foot peg 12 attached to pivot arm 11 is positioned at the bottom of upright frame strut 24. Extension arm 13 connects pivot arm 11 to latch bar 14 such that when foot peg 12 is depressed latch bar 14 is pivoted out of engagement with V-stop tab 15.

1 Claim, No Drawings

FOOT OPERATED MORTAR DRUM LATCH ASSEMBLY

BACKGROUND OF THE INVENTION

1. Technical Field

This invention relates to a foot operated mortar drum, latch assembly for use with a mortar mixer. More particularly it relates to a latch assembly for holding the mortar drum in an upright, mixing position, and releasing the latch by use of a foot peg and linkage assembly so that the operator can rotate the drum from the mixing position to a dumping position.

2. Background Art

Present day mortar mixers typically have a cylindrically shaped, horizontally oriented, drum open along the top, and a plurality of mixing paddles and wipers axially and rotatably secured within the drum. Dry mortar, sand and water are poured into the drum through the top opening. A rotation means, such as a gasoline engine, is provided to rotate the paddle axle to facilitate mixing the mortar. After the mortar has been mixed, the drum itself is rotated from the upright position, down to a dumping position where the mortar can be spilled out through the opening.

Mortar mixers, although portable, must be stoutly built for a number of reasons including the hostile, dusty environment, exposure to weather, abusive use by unskilled, inattentive and uncaring operators, and not the least of which, the fact that mortar is heavy. The typical mortar mixer drum will hold six to eight cubic feet of mortar which may weigh anywhere from 200–300 pounds per cubic foot. Eight cubic feet of mortar can weigh well over a ton. To rotate the cylindrical drum containing a ton of mortar from a mixing position to dumping position requires a lot of force. To facilitate this rotation of the drum, vertically oriented dumping handles are provided which can be grasped by the operator and pulled down to rotate the drum and dump the mortar.

A latching mechanism of some sort is also provided to keep the drum in the mixing position until it is desired to dump its contents. Tertinek et al., U.S. Pat. No. 3,905,519, discloses a typical latching system and drum handle. The problem is, as is shown in Tertinek et al., FIG. 1, that the latching mechanism is knee operated and as a result, the operator has to assume an unnatural and unbalanced stance in order to release the drum latch and dump its contents.

What is needed is a latch release system that can also serve as a foot brace to assist the mortar mixer operator in rotating the drum from a mixing position to a dumping position.

DISCLOSURE OF INVENTION

This object is accomplished by a development of a foot operated mortar drum latch assembly for use with a mortar mixer having a generally cylindrical and horizontally oriented mortar mixing drum which is rotatable from a mixing position where the drum opening is located on top, to a dumping position. A V-shaped stop tab extends normally from one of the end walls of the mortar mixing drum, and is aligned in close proximity to one of two upright frame struts which support the drum on rotatable shafts coincident to the cylindrical drum's central axis. The V-shaped stop tab is oriented such that one of the legs of the V-shaped stop tab is vertical when the drum is in the mixing position and the other extends in a direction opposite that for rotation of the drum to the dumping position.

A latch bar is pivotably attached to the adjacent upright frame strut and is positioned for engagement against the vertical leg of the V-shaped stop tab when the drum is in the mixing position. The segment of the latch bar which frictionally engages the V-shaped stop tab is cambered so that the second leg of the V-shaped stop tab will frictionally engage the cambered end of the latch bar and pivot the latch bar away from its engaged position when the drum is being returned to the mixing position from the dumping position. The latch bar, being pivotally mounted to the frame strut, normally remains in the engaged position to prevent rotation of the drum from the mixing position to the dumping position.

Located near the bottom of the upright frame strut, is a foot peg attached to the end of a pivot arm, which is pivotally attached to the frame strut. The foot peg being conveniently oriented so that a operator attempting to rotate the drum from the mixing position to the dumping position can use his foot against the foot peg to release the latch bar and also to provide a brace for the operator who will be simultaneously pulling down upon a generally vertically oriented drum handle. An extension arm pivotally connected to both the latch bar and the other end of the pivot arm provides a means for transferring the levered action of the pivot arm to the latch bar.

BEST MODE FOR CARRYING OUT INVENTION

Figure 1:
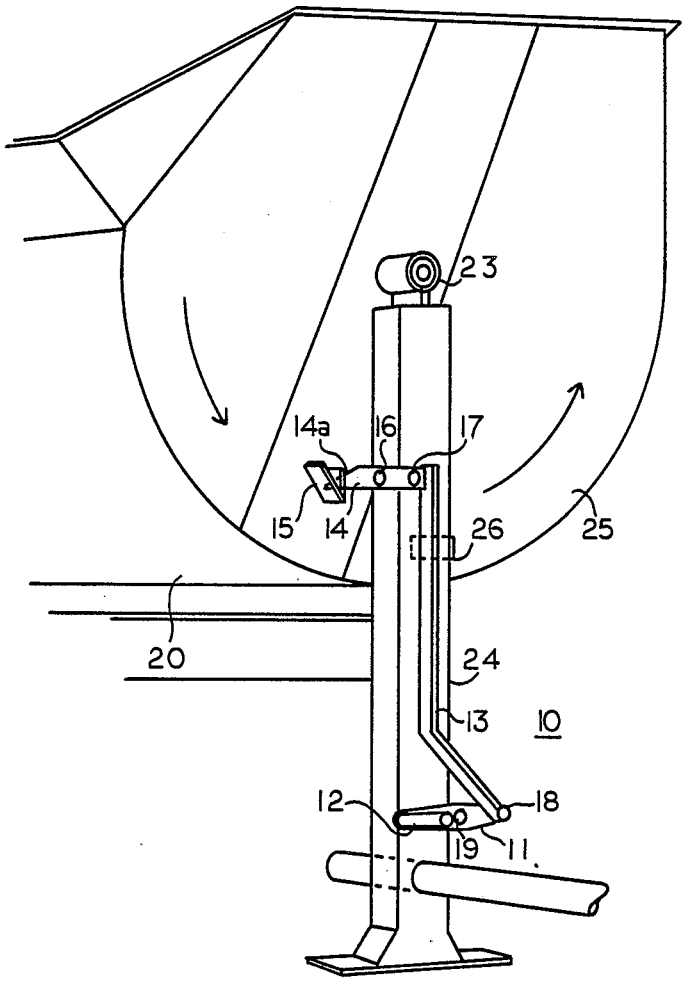
FIG. 1 is a representational perspective view of the foot operated mortar drum latch assembly.
Figure 2:
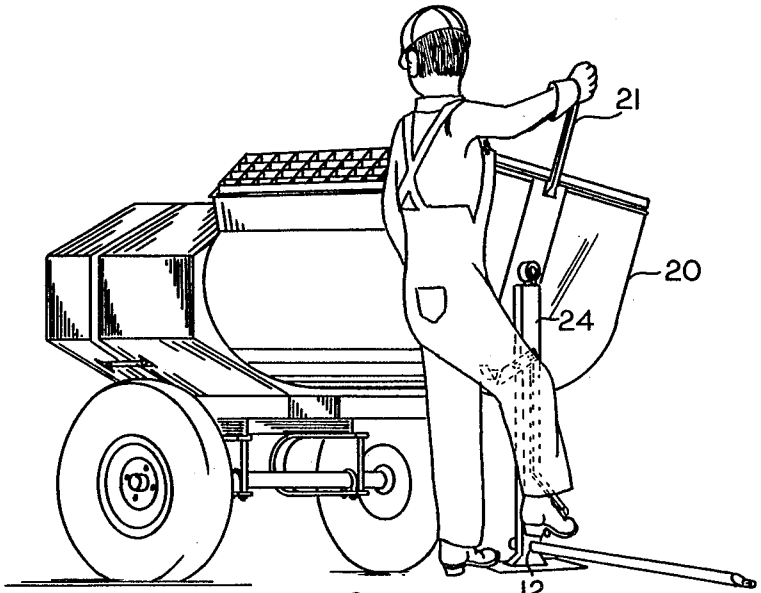
FIG. 2 is a representational perspective view of a mortar mixer with a operator using the foot operated drum release assembly.

As shown in FIG. 1 and FIG. 2, cylindrical mortar drum 20 is supported between upright frames struts 24 and supported for rotation, from a mixing position with the drum opening generally located at the top, to a dumping position, by bearing assemblies 23 which are located coincident to the longitudinally oriented axis of cylindrical mortar drum 20. Upright struts 24 are in close proximity with drum end walls 25 and therefore provide a convenient interface for a latch and release assembly.

V-shaped stop tab 15 is welded to drum end wall 25 and oriented such that one of the legs of the V-shaped stop tab is vertical when drum 20 is in the mixing position, and the second leg points in a direction opposite of that in which the drum will be rotated, as shown by the directional arrows in FIG. 1, to bring it from a mixing position to a dumping position. Latch bar 14 is provided for engagement with the stop tab 15 and is pivotally attached by means of latch bar pivot pin 16 to frame strut 24. A cambered edge **14*a* is provided at the latching end of latch bar 14 to frictionally engage with the second leg of V-shaped stop tab 15 when the drum is being returned from the dumping position to the mixing position. As drum 20 is returned to the mixing position cambered edge 14*a* of latch bar 14 is pushed down by the second leg of tab 15, thereby sliding latch bar 14 under and to the back of the first, now vertically oriented leg of stop tab 15 thereby resetting latch assembly 10 and preventing further rotation of drum 20 back to the dumping position unless and until latch assembly 10 is once again released. Stop bar 26 also extends out from drum end wall 25 and engages upright frame strut 24 to prevent further rotation of drum 20** when it is returned to the mixing position.

Pivot arm 11 is pivotably attached to the lower portion of upright frame strut 24 by means of pivot arm pin 19. Foot peg 12 extends normally out from pivot arm 11. Extension arm 13 is pivotably attached by means of lower extension arm pin 18 to the opposite end of pivot arm 11 and also by means of upper extension arm pin 17 to latch bar 14 and provides a means of translating a downward motion on foot peg 12 into a pivotal downward motion of cambered end 14*a* of latch bar 14 to release latch bar 14 from engagement with V-shaped stop tab 15.

By use of the foot peg 12, the operator enhances his ability and body leverage against the mortar mixer to assist, when, as is shown in FIG. 2, the operator grasps drum handle 21 and begins rotating mortar drum 20 down from its upright mixing position to a dumping position.

While there is shown and described the present preferred embodiment of the invention, it is to be distinctly understood that this invention is not limited thereto but may be variously embodied to practice within the scope of the following claims.

I claim:

1. In a mortar mixer having a horizontally oriented, generally cylindrical mortar mixing drum rotatable from a mixing position, with an opening in the drum located generally at the top of the drum, to a dumping position, said drum having end walls and being pivotally connected coincident to a cylindrical axis to a pair of opposing upright frame struts adjacent to said end walls, a foot operated mortar drum latch assembly which comprises:

a V-shaped stop tab extending normally from a drum end wall and oriented thereon such that one leg of the V-shaped stop tab is vertically oriented when the drum is in the mixing position and the other leg extending in a direction opposite of that for rotation of the drum to the dumping position;

a latch bar having a cambered end pivotally attached to the adjacent upright frame strut with its cambered end in frictional engagement against the vertically oriented arm of the V-shaped stop tab when the drum is in a mixing position so that drum rotation from a mixing position to a dumping position cannot occur unless the latch bar is pivoted to a release position, and such that the second leg of the V-shaped stop tab will frictionally engage the cambered end of the latch bar and pivot said latch bar from the engaged position to the release position;

a pivot arm being pivotally attached to the lower end of the upright frame strut and disposed to pivot about an axis substantially parallel to the cylindrical axis;

a foot peg extending normally out from one end of the pivot arm substantially parallel to the cylindrical axis;

an extension arm for pivotal attachment at one end of the pivot arm opposite that to which the foot peg is attached and pivotally attached at its other end to the latch bar so that when the pivot arm is pushed down at the foot peg end, the latch bar is pivoted down away from the engaged position with V-shaped stop tab to the release position; and a drum handle attached to and extending radially upward from the drum at the end wall of the drum adjacent the upright frame member to which the pivot arm is attached, whereby, the handle and the foot peg are disposed to enhance the operator's body leverage when rotating the drum from a mixing position to a dumping position.

* * * * *